US006195927B1

(12) United States Patent
Fortenberry

(10) Patent No.: US 6,195,927 B1
(45) Date of Patent: Mar. 6, 2001

(54) FIREARM GRIPPING DEVICE

(76) Inventor: Marc A. Fortenberry, 1309 E. Cherry St., Springfield, MO (US) 65802

( * ) Notice: Subject to any disclaimer, the term of this patent is extended or adjusted under 35 U.S.C. 154(b) by 0 days.

(21) Appl. No.: 09/295,096

(22) Filed: Apr. 21, 1999

(51) Int. Cl.[7] ..... F41C 27/00
(52) U.S. Cl. ..... 42/90
(58) Field of Search ..... 42/90, 104, 106; 2/21, 163; D4/103; D2/610

(56) References Cited

U.S. PATENT DOCUMENTS

| | | | | |
|---|---|---|---|---|
| 2,457,755 | | 12/1948 | Ugazio et al. . | |
| 3,086,529 | | 4/1963 | Munz et al. . | |
| 3,368,811 | * | 2/1968 | Finney | 42/106 |
| 4,395,837 | | 8/1983 | Durnal . | |
| 4,796,306 | * | 1/1989 | Mitchell | 2/162 |
| 4,982,522 | * | 1/1991 | Norton | 42/90 |
| 5,131,095 | * | 7/1992 | D'Amato | 2/21 |
| 5,293,884 | | 3/1994 | Chapman et al. . | |
| 5,435,013 | * | 7/1995 | Davis | 2/163 |
| 5,664,360 | | 9/1997 | Conway . | |

FOREIGN PATENT DOCUMENTS

| | | |
|---|---|---|
| 2050810 | 1/1981 | (DE) . |

* cited by examiner

*Primary Examiner*—Peter M. Poon
*Assistant Examiner*—Elizabeth Shaw
(74) *Attorney, Agent, or Firm*—Stephen R. Greiner

(57) ABSTRACT

A firearm gripping device including an elastomeric band for encircling the closed hand of a user. A first fastening portion is secured to one side of the band. A second fastening portion, adapted to mate with, and releasably adhere to, the first fastening portion, is secured to the band adjacent the rear end thereof. An elastomeric strap is secured to the side of the band opposite the one carrying the first fastening portion so as to form at least one, large loop. In use, a finger of a hand gripping a firearm are inserted into the loop and the strap is wrapped around the hand and the firearm grip so that the fastening portions can be engaged with one another.

12 Claims, 1 Drawing Sheet

FIREARM GRIPPING DEVICE

FIELD OF THE INVENTION

The present invention relates generally to firearms and, more particularly, to implements therefor.

BACKGROUND OF THE INVENTION

When approaching a potentially dangerous person, a policeman will often draw his handgun for ready use. If the person being approached chooses to either fight or flee, the policeman is protected. This protection is often illusory since many scuffles and chases have resulted in handguns being advertently dropped, lost, or taken from policemen. Not only do many dangerous individuals escape justice when a policeman loses possession of his handgun but, in some cases, they sometimes use wrongfully obtained handguns against their pursuers to inflict serious bodily harm.

SUMMARY OF THE INVENTION

In light of the problems associated with today's firearms which are often difficult to hold, it is a principal object of the invention to provide a firearm gripping device which binds the hand of a user to the grip of a firearm thereby making it difficult to drop the firearm or to pry such from the hand of a user. The inventive gripping device is particularly advantageous in promoting a solid grasp of a firearm by users with small hands.

It is another object of the invention to provide a gripping device of the type described which can be used with virtually all handguns, rifles and shotguns without modification being made to the chosen weapon.

It is a further object of the invention to provide a gripping device of the type described which permits a user to obtain a strong grasp of a firearm without excessive muscle fatigue so that the firearm can be aimed and discharged with maximum control.

It is an object of the invention to provide improved elements and arrangements thereof in a firearm gripping device for the purposes described which is lightweight in construction, inexpensive to manufacture, and dependable in use.

Briefly, the firearm gripping device in accordance with this invention achieves the intended objects by featuring an elastomeric band having a fastening layer with a dense mat of small, uncut loops formed of thread extending from one of its sides. A strip of hook-type fastening material is secured to the band adjacent its rear end. The strip has a plurality of hooks releasably fastenable to the small loops of the fastening layer. An elastomeric strap is secured to the band adjacent its front end so as to form a pair of relatively large loops.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
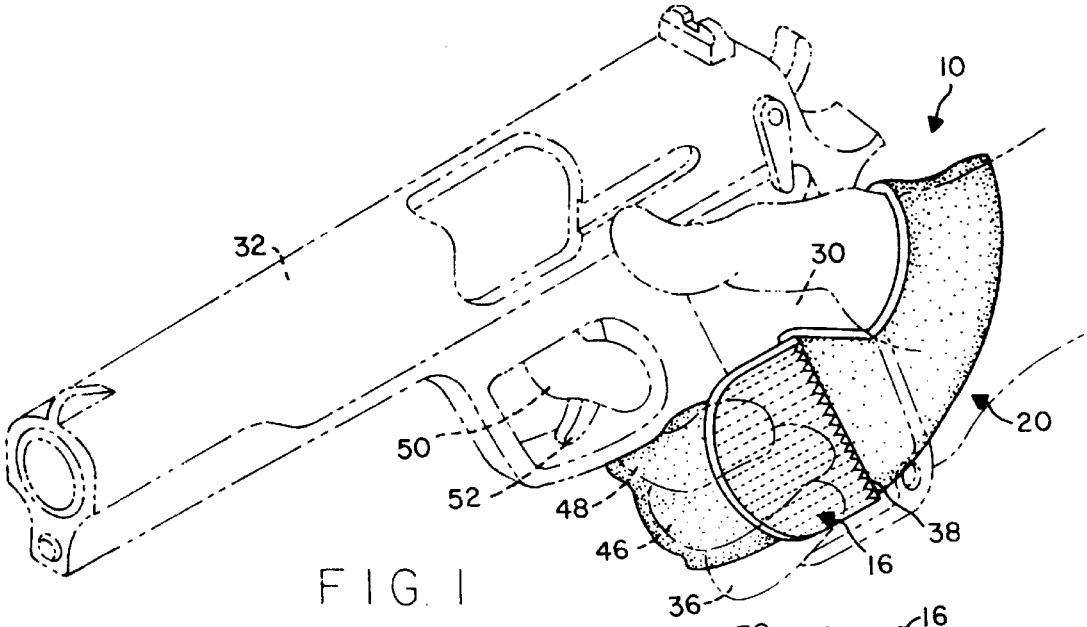
FIG. 1 is a perspective view of a firearm gripping device in accordance with the present invention shown securing the hand of a user to the grip of a handgun.
Figure 2:
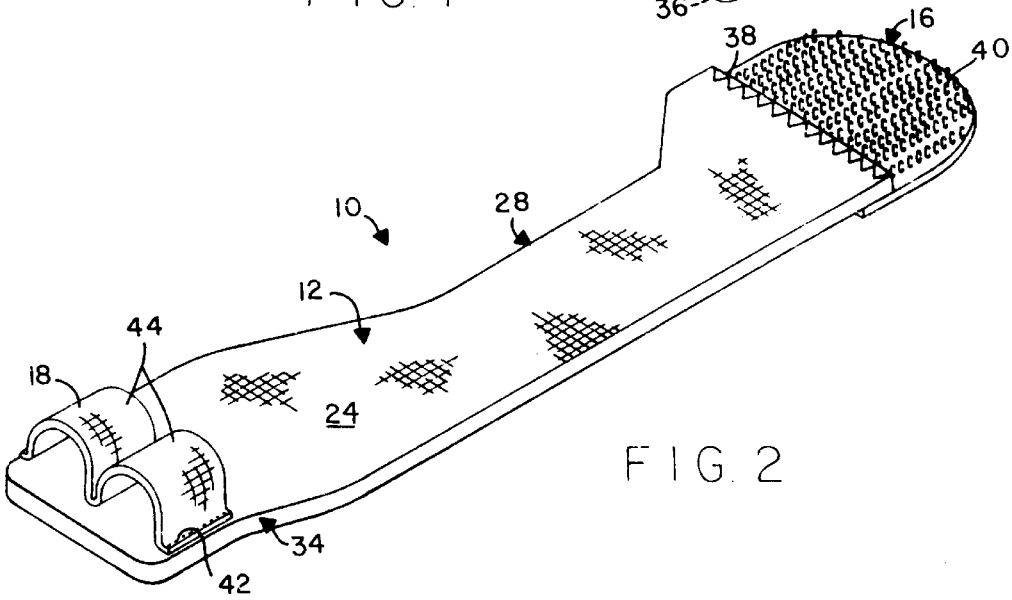
FIG. 2 is a perspective view of the firearm gripping device of FIG. 1 in a fully extended position.
Figure 3:
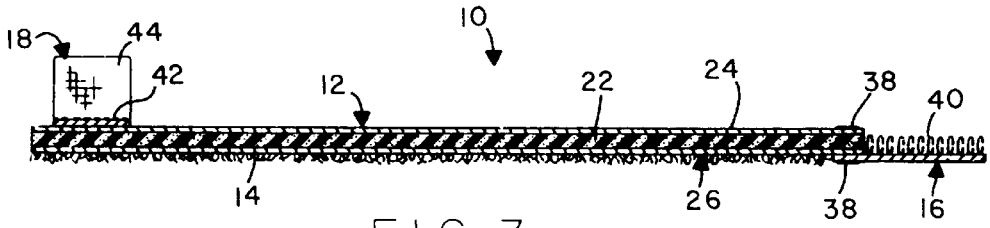
FIG. 3 is a longitudinal cross section of the firearm gripping device.

Referring now to the FIGS., a firearm gripping device in accordance with the present invention is shown at 10. The device 10 includes an elastomeric band 12 having a multitude of small loops 14 extending from one of its sides. A strip of hook-type fastening material 16 is secured to the rear end of the band 12 and may be used in cooperation with the loops 14 to form the band 12 into a hand-encircling ring of variable diameter. An elastomeric strap 18 is secured to the front end of the band 12 for anchoring the device 10 to a user's hand 20.

The band 12 has three layers 22, 24 and 26 which are adhesively secured to one another so as to form a thin, flexible, stretchable and resilient sandwich. The central layer 22 comprises a sheet of neoprene foam. To one side of the central layer 22 is secured a protective layer 24 of woven fabric for maximizing user comfort and neoprene foam life. Secured to the opposite side of the central layer 22 is a fastening layer 26 of "Velcro" pile fabric having a dense mat of small, uncut loops 14 formed of thread.

The preferred band 12 is about 10 inches (25 cm) long, 3/16 of an inch (0.5 cm) wide, and 2¾ inches (7 cm) tall at its tallest points. The height of the band 12 varies since its top edge has a concavity 28 with a maximum depth of about 1 inch (2.5 cm) to provide clearance from the grip 30 of handgun 32 during use. A similar concavity 34 is located in the bottom edge of the band 12 which allows movement of the little finger 36 of hand 20 so that certain handguns can be loaded through the bottoms of their grips without interference.

By means of zig-zag stitching 38, the strip of hook-type fastening material 16 is secured to the rear end of the band 12. The fastening material 16 comprises a piece of "Velcro" hooked fabric having a plurality of transverse lines of hooks 40 spaced along its length. The ends of the hooks 40 are turned inwardly so as to catch in the loops 14 of the fastening layer 26 when pressed against such.

The strip of hook-type fastening material 16 has a height of about 2¾ inches (7 cm) and a length of about 1½ inches (4 cm). Because the strip 16 is shorter than the fastening layer 26 of band 12, the strip 16 may be selectively fastened at various points along the length of the fastening layer 26. Thus, a single device 10 dimensioned as described above can accommodate individuals having hands and firearm grips of widely differing dimensions.

The strap 18 is formed of a loosely woven fabric made flexible by strands of rubber running through it. The strap 18 is secured by three, sewn seams as at 42 to the band 12 adjacent its protective layer 24. The seams 42 are arranged such that two, large, side-by-side loops 44 are formed in the strap 18. The loops 44 snugly accommodate the ring finger 46 and middle finger 48 of hand 20. Index finger 50 remains free to pull the trigger 52 of handgun 32.

Use of the firearm gripping device 10 is straightforward. First, the fingers 46 and 48 are inserted into loops 44. Next, the grip 30 of handgun 32 is grasped by the hand 20 in the normal manner with index finger 50 on trigger 52. The band 12 is then wrapped around the back of the hand 20, and the strip of hook-type fastening material 16 is positioned closely adjacent the loop-type layer 24. Now, by pressing, the hooks

40 may be caused to enter and grasp the loops 14 thereby coupling together the overlapping fastening portions of the device 10.

Release of the interlocked hooks 40 and loops 14 is effected by grasping the free end of the strip of hook-type material 16 and pulling generally outwardly on the same. This will cause the hooks 40 and the loops 14 to disengage. The transverse line of disengagement will progress lengthwise along the strip 16 and layer 26 so that they will separate smoothly. The device 10 may now be easily stored and transported in a flat, ready-to-use condition.

While the invention has been described with a high degree of particularity, it will be appreciated by those skilled in the art that modifications may be made thereto. For example, buttons, buckles, clasps, and the like may be substituted for the hook and loop fastening portions provided. Therefore, it is to be understood that the present invention is not limited to the sole embodiment described above, but encompasses any and all embodiments within the scope of the following claims.

I claim:

1. A firearm gripping device, comprising:

an elastomeric band adapted to encircle the closed hand of a user and having: a first side and an opposed second side, a top edge, a bottom edge, a front end, and a rear end;

a first fastening portion secured to said first side of said elastomeric band; and, a second fastening portion, adapted to mate with, and releasably adhere to, said first fastening portion, secured to said elastomeric band adjacent said rear end thereof; and, an elastomeric strap secured to said second side of said elastomeric band adjacent said front end thereof so as to form at least one, large loop for receiving a finger of a user.

2. The firearm gripping device according to claim 1 wherein said top edge has a concavity between said front end and said rear end for providing clearance from the grip of a handgun during use.

3. The firearm gripping device according to claim 1 wherein said bottom edge has a concavity adjacent said front end for unimpeded movement of the little finger of the hand of a user.

4. The firearm gripping device according to claim 1 wherein:

said first fastening portion has a dense mat of small uncut loops; and, said second fastening portion has a plurality of hooks releasably fastenable with said loops of said first fastening portion.

5. The firearm gripping device according to claim 4 wherein said second fastening portion extends outwardly from said rear end of said elastomeric band.

6. The firearm gripping device according to claim 4 wherein said first fastening portion is coextensive with said first side of said elastomeric band.

7. A firearm gripping device, comprising:

an elastomeric band adapted to encircle the closed hand of a user and having: a first side and an opposed second side, a top edge, a bottom edge, a front end, and a rear end;

a first fastening portion coextensive with said first side of said elastomeric band, said first fastening portion having a dense mat of small, uncut loops;

a second fastening portion secured to said elastomeric band adjacent said rear end thereof, said second fastening portion having a plurality of hooks releasably fastenable to said small, uncut loops of said first fastening portion; and, an elastomeric strap secured to said second side of said elastomeric band adjacent said front end thereof so as to form a pair of large loops for receiving two adjacent fingers of a user.

8. The firearm gripping device according to claim 7 wherein said top edge has a concavity between said front end and said rear end for providing clearance from the grip of a handgun during use.

9. The firearm gripping device according to claim 8 wherein said bottom edge has a concavity adjacent said front end for unimpeded movement of the little finger of the hand of a user.

10. The firearm gripping device according to claim 7 wherein said second fastening portion extends outwardly from said rear end of said elastomeric band.

11. A firearm gripping device, comprising:

an elastomeric band adapted to encircle the closed hand of a user and including a top edge, a bottom edge, a front end, and a rear end, said elastomeric band further including:

a central layer of neoprene foam having opposed sides;

a protective layer of woven fabric secured to one side of said central layer, said protective layer being coextensive with said protective layer; and, a fastening layer having a dense mat of small, uncut loops formed of thread secured to the other side of said central layer, said fastening layer being coextensive with said central layer;

a strip of hook-type fastening material secured to said elastomeric band adjacent said rear end thereof, said strip of hook-type fastening material having a plurality of hooks releasably fastenable to said small, uncut loops of said fastening layer of said elastomeric band; and, an elastomeric strap secured to said elastomeric band adjacent said front end and protective layer thereof so as to form a pair of large loops for receiving two adjacent fingers of a user.

12. The firearm gripping device according to claim 11 wherein said top edge has a concavity between said front end and said rear end and said bottom edge has a concavity adjacent said front end.

* * * * *